US008870585B2

(12) United States Patent
Lee et al.

(10) Patent No.: US 8,870,585 B2
(45) Date of Patent: Oct. 28, 2014

(54) CONNECTOR FOR FLEXIBLE CIRCUIT CABLE

(71) Applicant: Molex Incorporated, Lisle, IL (US)

(72) Inventors: Jae-Hyung Lee, Ansan (KR); Suk-Min Kim, Ansan (KR)

(73) Assignee: Molex Incorporated, Lisle, IL (US)

( * ) Notice: Subject to any disclaimer, the term of this patent is extended or adjusted under 35 U.S.C. 154(b) by 78 days.

(21) Appl. No.: 13/762,573

(22) Filed: Feb. 8, 2013

(65) Prior Publication Data

US 2014/0065864 A1 Mar. 6, 2014

(30) Foreign Application Priority Data

Feb. 8, 2012 (KR) ..... 10-2012-0012730

(51) Int. Cl.
*H01R 13/62* (2006.01)

(52) U.S. Cl.
USPC ..... 439/260; 439/495

(58) Field of Classification Search
USPC ..... 439/260, 495
See application file for complete search history.

(56) References Cited

U.S. PATENT DOCUMENTS

| | | | | |
|---|---|---|---|---|
| 4,863,395 | A * | 9/1989 | Babuka et al. | 439/260 |
| 6,921,274 | B2 | 7/2005 | Yu | |
| 7,452,227 | B2 | 11/2008 | Matoba et al. | |
| 7,785,121 | B2 | 8/2010 | Ito et al. | |
| 7,883,344 | B1 * | 2/2011 | Felton et al. | 439/135 |
| 8,137,131 | B2 * | 3/2012 | Wang et al. | 439/570 |
| 8,465,317 | B2 * | 6/2013 | Gniadek et al. | 439/344 |

FOREIGN PATENT DOCUMENTS

KR 10-0666111 12/2006

* cited by examiner

*Primary Examiner* — Gary Paumen
(74) *Attorney, Agent, or Firm* — Timothy M. Morella

(57) ABSTRACT

The connector of the Present Disclosure for a flexible circuit cable comprises a housing on the front whereof is formed an insertion slot for a flexible circuit cable, and on the front and rear whereof is formed a terminal insertion hole; a plurality of contact terminals inserted into the front and rear of the housing via the terminal insertion holes; an actuator that pivots around a pivot axis and, when in closed position, creates electrical contact between the contact terminal and the conductor part of the flexible circuit cable by pressing the inserted flexible circuit cable down and into the housing; and a molded dust cover that pivots with the actuator and is installed on the housing to enable rotation and thus prevent the introduction of dust; and has a structure wherein on either end part of the molded dust cover is formed a rotation axis groove, and rotation axis projections are formed on either side of the housing to enable coupling with the rotation axis grooves.

14 Claims, 11 Drawing Sheets

CONNECTOR FOR FLEXIBLE CIRCUIT CABLE

REFERENCE TO RELATED APPLICATIONS

The Present Disclosure claims priority to prior-filed Korean Patent Application No. 10-2012-0012730, entitled "Connector for Flexible Circuit Cable," filed on 8 Feb. 2012 with the Korean Intellectual Property Office. The content of the aforementioned Patent Application is incorporated in its entirety herein.

BACKGROUND OF THE PRESENT DISCLOSURE

The Present Disclosure relates, generally, to a connector for connecting a flexible circuit cable to a printed circuit board, and, more particularly, to a flexible circuit cable connector wherein the molded dust cover is integrated with the actuator so that it is actuated together with the actuation of the actuator, and is made of synthetic resin so that the assembly process is simplified and noise is not generated in the circuit.

In order to increase design freedom in information technology products and the like, it has been conventional to use Flexible Printed Circuits (FPC) and Flexible Flat Cables (FFC) of a flexible material rather than rigid printed circuit boards.

Most conventional flexible circuit cable connectors have a structure wherein a conductor part, e.g., a contact terminal, is exposed in certain places after the actuator was closed. If dust or other contaminants are present between conductor and conductor in the exposed conductor part, an electrical short occurs and causes circuit damage or malfunction, so a separate structure such as a dust cover is added, or temporary taping is applied.

However, these methods require additional processes and in terms of durability, are no more than temporary and unsafe fixes, since, for example, the taped part can easily drop off under heat.

In Korean Patent No. 10-0666111, the content of which is incorporated herein in its entirety, a dust cover for a cable connector is disclosed. However, this dust cover for a conventional cable connector art has a structure that couples to the housing, and is not connected to the actuator. This creates the structural problem that the action of coupling or separating the dust cover and housing is inconvenient, and can also hinder the operation of the actuator.

SUMMARY OF THE PRESENT DISCLOSURE

The dust covers of the prior art are generally configured in two ways, either with the actuator being fastened in a separate work process or with it being configured to rotate using a metal material. In the former case, it is necessary to deal with difficulties due to the additional process, while in the latter case the metal material produces a problematic amount of circuit noise. The Present Disclosure has the objective of providing a flexible circuit cable connector wherein the molded dust cover is coupled together with the actuator in a single unit so that it is actuated by the actuation of the actuator, and is made of synthetic resin, thus simplifying the assembly process and avoiding the production of circuit noise.

To achieve the above-described objective, the flexible circuit cable connector according to one embodiment of the Present Disclosure comprises a housing on the front whereof is formed an insertion slot for a flexible circuit cable, and on the front and rear whereof a terminal insertion hole is formed; a plurality of contact terminals inserted into the front and rear of the housing via the terminal insertion holes; an actuator that pivots around a pivot axis and when in closed position creates electrical contact between the contact terminal and the conductor part of the flexible circuit cable by pressing the inserted flexible circuit cable downward and into the housing; and a molded dust cover that pivots together with the actuator and is installed on the housing so as to enable rotation, thus preventing the introduction of dust. The connector has a structure such that on either side of the molded dustcover is formed a rotation axis groove, and rotation axis projections are formed on either side of the housing so as to couple with the rotation axis grooves.

On the front end of the molded dust cover is formed a guide projection prevent separation from the actuator and guide the slip of the molded dust cover when the actuator is pivoted. On either side of the housing, a detachment prevention wall is formed to prevent detachment of the molded dust cover.

As described hereinabove, the Present Disclosure has the effects that due to coupling of the molded dust cover with the actuator as a single unit, it operates together with the actuator, and due to being made of synthetic resin, the assembly process is simplified and noise is not produced in the circuit.

In addition, the Present Disclosure can increase product reliability by preventing improper actuation or damage to the circuit due to a short, by effectively preventing the introduction of dust and contaminants into the actuator due to the molded dust cover being configured to slip (or slide) with respect to the actuator when the actuator is switched from open to closed position.

In addition, the Present Disclosure has the effect of enabling smooth actuation of the circuit by guiding the slip of the molded dust cover during axis rotation, in addition to preventing the molded dust cover from detaching from the actuator by the use of two guide projections.

In addition, the Present Disclosure can increase the reliability of the product by preventing downward separation of the molded dust cover when external force, etc. is applied to the actuator or the molded dust cover, due to the separation prevention wall.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
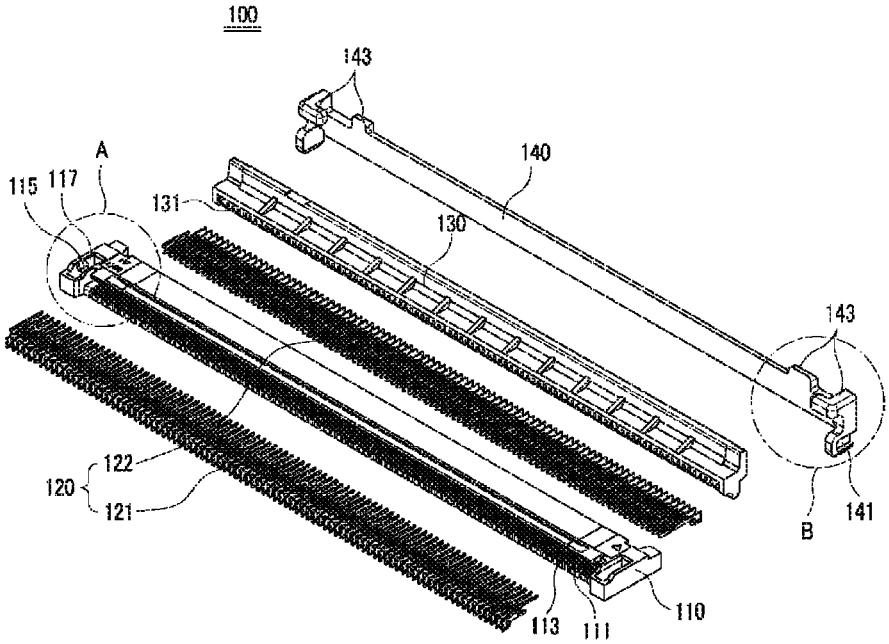
FIG. 1 is an exploded oblique view showing a flexible circuit cable connector according to an embodiment of the Present Disclosure.
Figure 2:
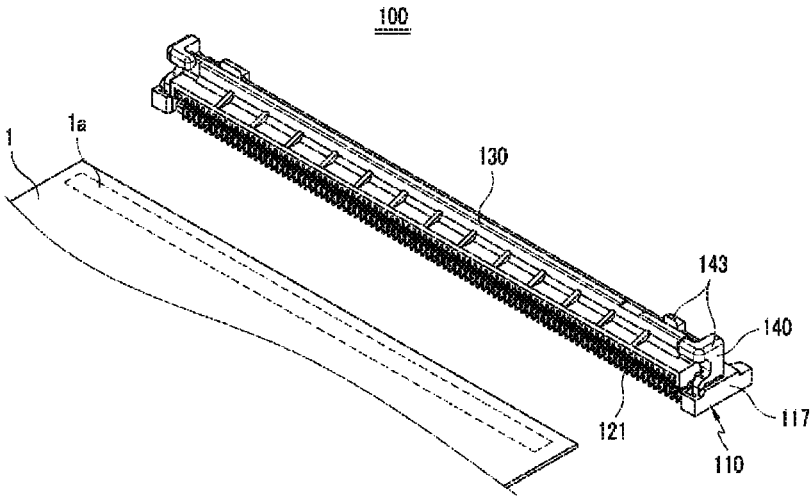
FIG. 2 is a perspective view of the connected state of the flexible circuit cable connector of FIG. 1 in an open position.
Figure 3:
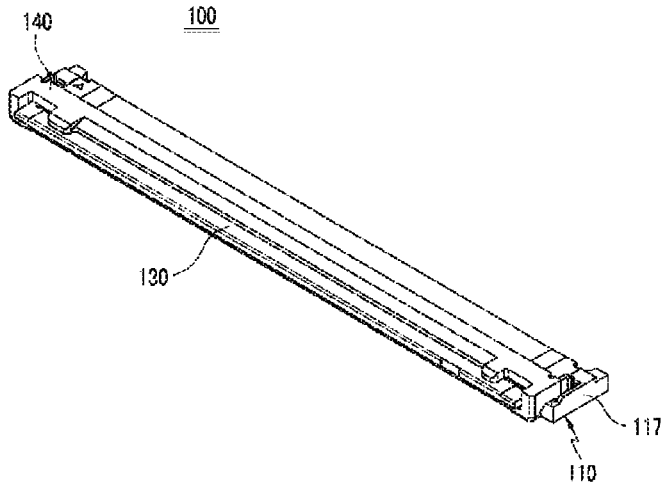
FIG. 3 is a perspective view of the connected state of the flexible circuit cable connector of FIG. 1 in a closed position.
Figure 4:
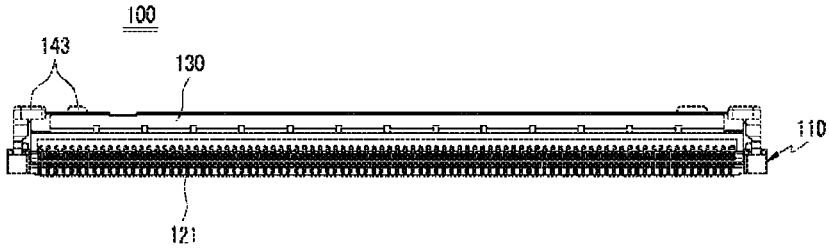
FIG. 4 is a front view of FIG. 2.
Figure 5:
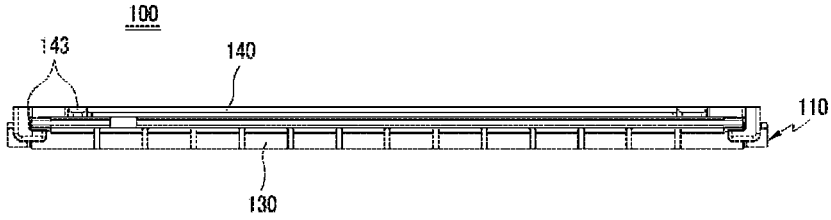
FIG. 5 is a front view of FIG. 3.
Figure 6:
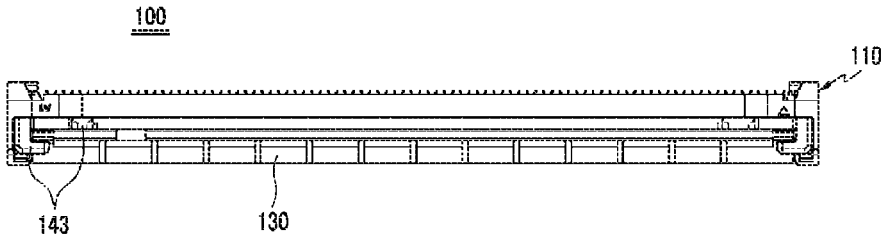
FIG. 6 is a top view of FIG. 2.
Figure 7:
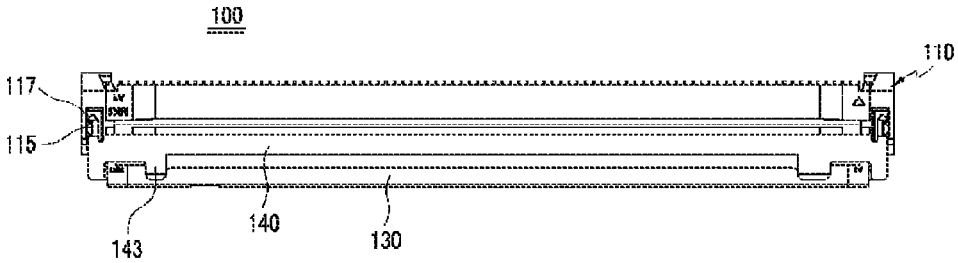
FIG. 7 is a top view of FIG. 3.
Figure 8:
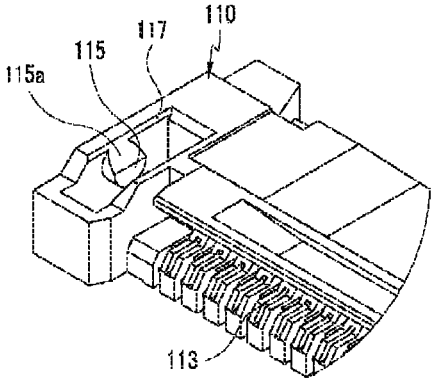
FIG. 8 is an expanded view of "A" in FIG. 1.
Figure 9:
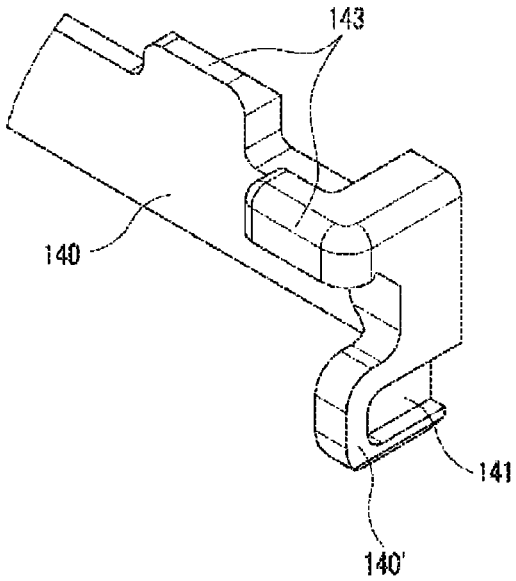
FIG. 9 is an expanded view of "B" in FIG. 1.
Figure 10A:
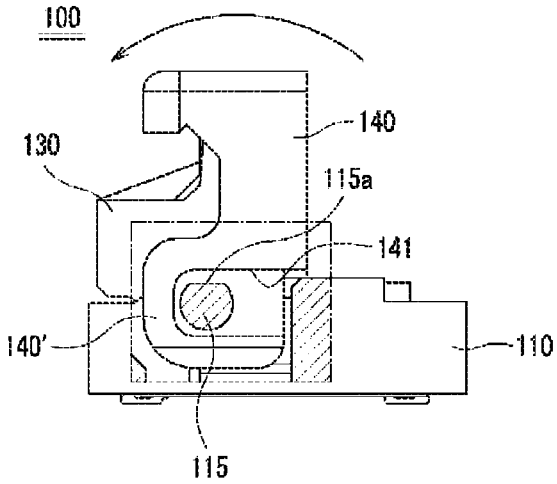
FIG. 10*a* illustrates a cross-section of the hinge part of the molded dust cover in an open position.
Figure 10B:
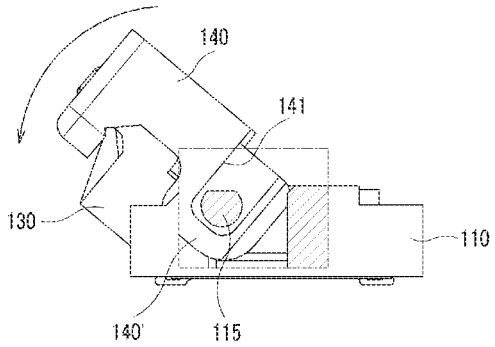
FIG. 10*b* illustrates a cross-section of the hinge part of the molded dust cover, showing actuator pivoting.
Figure 10C:
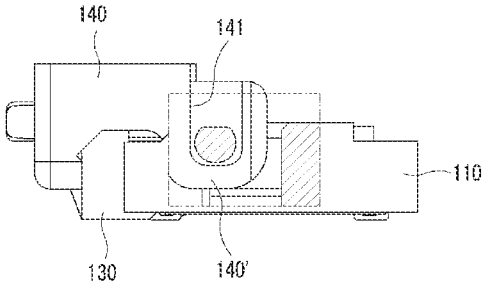
FIG. 10*c* illustrates a cross-section of the hinge part of the molded dust cover in a closed position.
Figure 11:
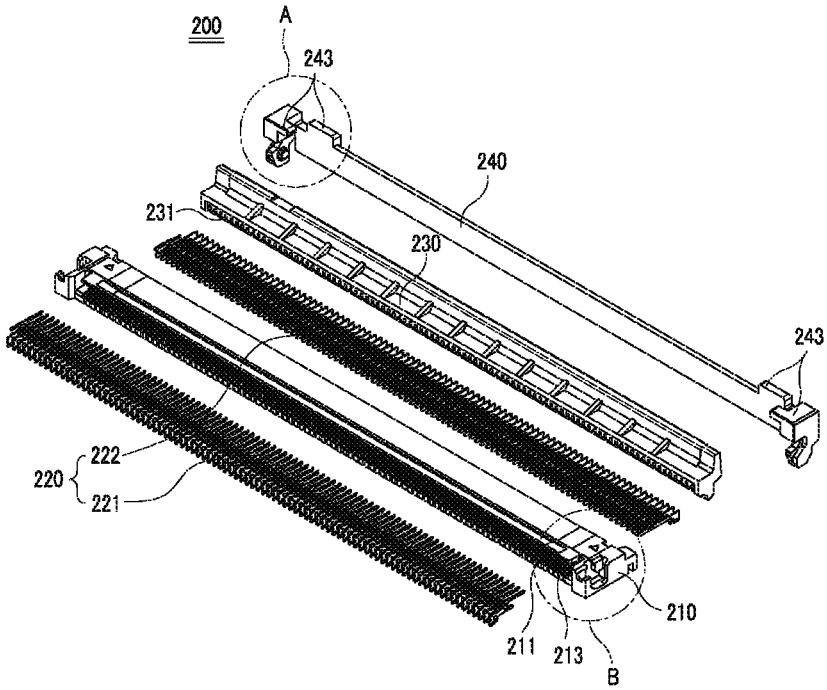
FIG. 11 is an exploded oblique view showing a flexible circuit cable connector according to an embodiment of the Present Disclosure.
Figure 12:
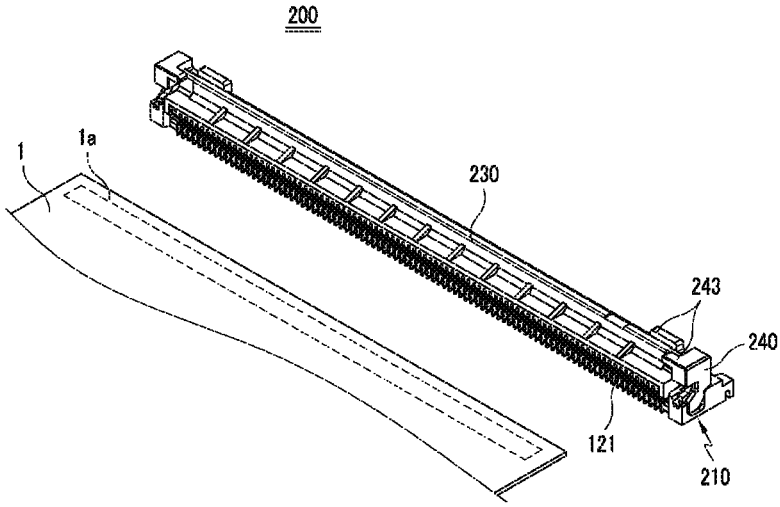
FIG. 12 is a perspective view of the connected state of the flexible circuit cable connector of FIG. 11 in an open position.
Figure 13:
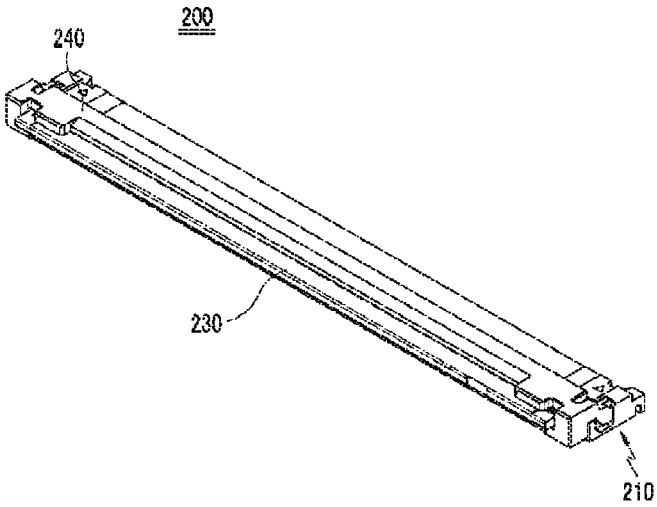
FIG. 13 is a perspective view of the connected state of the flexible circuit cable connector of FIG. 11 in a closed position.
Figure 14:
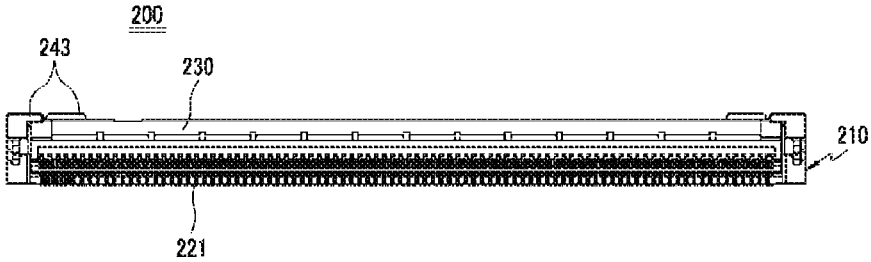
FIG. 14 is a front view of FIG. 12.
Figure 15:
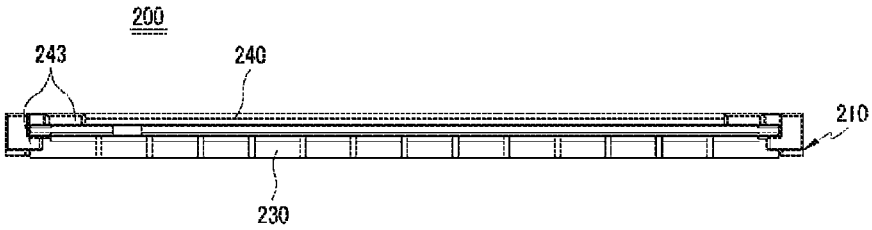
FIG. 15 is a front view of FIG. 13.
Figure 16:
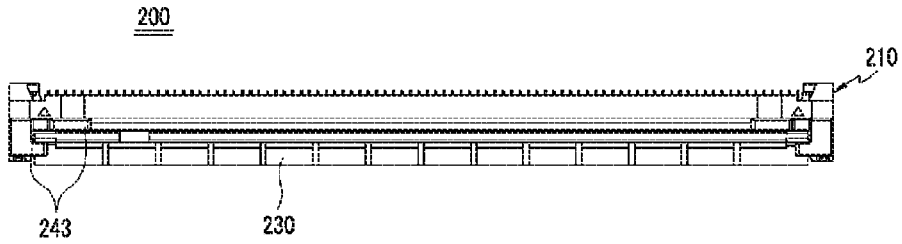
FIG. 16 is a top view of FIG. 12.
Figure 17:
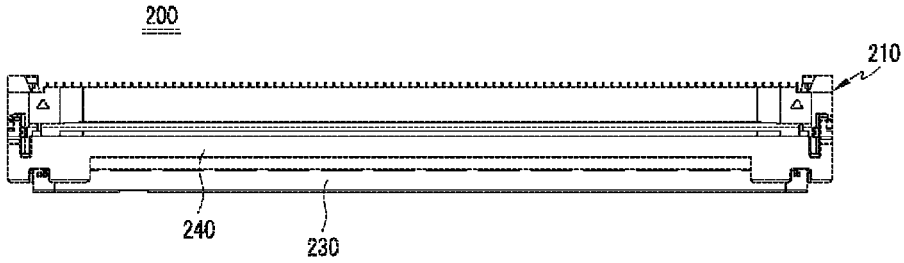
FIG. 17 is a top view of FIG. 13.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to FIGS. 1-10, a flexible circuit cable connector 100 according to an embodiment of the Present Disclosure comprises a housing 110, on the front whereof is formed an insertion slot 111 for a flexible circuit cable, and on the front and rear whereof a terminal insertion hole 113 is formed; a plurality of contact terminals 120 inserted into the front and rear of the housing via the terminal insertion holes 113; an actuator 130 that pivots around a pivot axis 131 and, when in closed position, creates electrical contact between the contact terminal 120 and the conductor part 1*a* of the flexible circuit cable 1 by pressing the inserted flexible circuit cable 1 down and into the housing 110; and a molded dust cover 140 that pivots with the actuator 130 and is installed on the housing 110 so as to enable rotation and thus prevent the introduction of dust. The flexible circuit cable connector 100 has a structure wherein on either end part 140' of the molded dust cover 140 is formed a rotation axis groove 141, and rotation axis projections 115 are formed on either side of the housing 110 so as to enable coupling with the rotation axis grooves 141. Looking at the configuration of the flexible circuit cable connector 100 according to an embodiment of the Present Disclosure, the housing 110 is ordinarily formed of synthetic resin, etc., for the purpose of insulation.

Within the terminal insertion hole 111, a plurality of contact terminals 120 are inserted and coupled. Into the front of the housing 110 are inserted the first contact terminals 121, and into the rear of the housing 110 are inserted the second contact terminals 122. One end of the contact terminal 120 is fixed to the printed circuit board (not shown), and the other end of the contact terminal 120 is configured to connect to and electrically contact the conductor part 1*a* of the flexible circuit cable 1. The contact terminal 120 is ordinarily formed of a copper alloy.

The actuator 130 is configured to pivot around a pivot axis 131, and to cause electrical contact between the contact terminal 120 and the conductor part 1*a* of the flexible circuit cable 1 in closed position, by pressing the flexible circuit cable 1 downward when it has been inserted into the housing 110. The molded dust cover 140 is made of synthetic resin, and acts to prevent the introduction of dust and contaminants by being installed so as to pivot within the housing 110 along with the actuator 130.

To support the rotation of the molded dust cover 140, a rotation axis groove 141 (See FIG. 9) is formed on either end part 140' of the molded dust cover 140, and a rotation axis projection 115 (See FIG. 8) is formed on either side of the housing 110 to enable coupling to the rotation axis groove 141. In the closed position of the actuator 130, the either end part 140' should preferably have a "U" or cap shape so that the molded dust cover 140 cannot detach in either a vertical or horizontal direction. The molded dust cover 140 has a rotatable central axis, and an inclined surface 115*a* (See FIG. 8) is formed on the rotation axis projection 115 so that the molded dust cover 140 can readily be inserted. In the closed position of the actuator 130, the molded dust cover 140 prevents external exposure of the contact terminal 120 by covering it, thus effectively preventing shorts and improper actuation due to the introduction of dust or impurities.

On the front end of the molded dust cover 140, a guide projection 143 (See FIG. 9) is formed in order to prevent detachment from the actuator 130 and to guide the slip motion of the molded dust cover 140 when the actuator 130 is pivoted. Somewhat more specifically, the two guide projections 143 not only prevent detachment of the molded dust cover 140 and the actuator 130, but also act to ensure smooth operation when the actuator 130 is pivoted, by virtue of being positioned at the front and back of the actuator 130, by guiding the slip motion of the molded dust cover 140 when the molded dust cover 140 is pivoted at the same rotation angle as the actuator 130.

On either side of the housing 110, a detachment prevention wall 117 (See FIG. 8) is formed to prevent detachment of the molded dust cover 140. The detachment prevention wall 117 acts to prevent detachment of the molded dust cover 140 in an outward direction when an external force, etc., is applied to the actuator 130 or the molded dust cover 140.

Flexible circuit cables here include not only FPCs and FFCs, but also flexible cables of 0.1 mm or less, such as a chip on film or tape carrier packages loaded with a display driver IC. Further, "open position" refers to the actuator 130 being positioned vertically, in the state prior to the insertion of a flexible circuit cable into the housing 110; "closed position" refers to the position with the actuator 130 pivoted to horizontal position after the insertion of the flexible circuit cable into the housing 110, in which electrical contact is established between the contact terminal 120 and the conductor part 1*a* of the flexible circuit cable 1.

The effected operation of the flexible circuit cable connector 100 according to the thus-configured embodiment of the Present Disclosure can be described as follows. When switching the actuator 130 from open to closed position, when the actuator 130 is pivoted, the actuator 130 pivots around the pivot axis 131. The molded dust cover 140 then pivots around the pivot axis projection 115 together with the actuator 130 (See FIGS. 10*a*-10*b*). The guide groove 143 acts to prevent detachment (separation) of the molded dust cover 140 from the actuator 130, and to guide the slip motion of the molded dust cover 140 when the actuator 130 is pivoted. The detachment prevention wall 117 formed on either side of the housing 110 acts to prevent unintended detachment (separation) of the molded dust cover 140. In the closed position of the actuator 130, the molded dust cover 140 prevents external exposure of the contact terminal 120 by covering it, thus effectively preventing shorts and improper actuation due to the introduction of dust or impurities (See FIG. 10*c*).

Referring to FIGS. 11-21, the flexible circuit cable connector 200 according to another embodiment of the Present Disclosure comprises a housing 210, on the front whereof is formed an insertion slot 211 for a flexible circuit cable, and on the front and rear whereof a terminal insertion hole 213 is formed; a plurality of contact terminals 220 inserted into the front and rear of the housing 210 via the terminal insertion holes 213; an actuator 230 that pivots around a pivot axis 231 and, when in closed position, creates electrical contact between the contact terminal 220 and the conductor part of the flexible circuit cable 1 by pressing the inserted flexible circuit cable 1 down and into the housing 210; and a molded dust cover 240 that pivots with the actuator 230 and is installed on the housing 210 to enable rotation and thus prevent the introduction of dust. On either end of the molded dust cover 240 is formed a rotation axis groove 241, and rotation axis projections 215 are formed on either side of the housing 210 so as to enable coupling with the rotation axis grooves 241. Considering the configuration of the flexible circuit cable connector 200 according to this embodiment in somewhat greater detail, the housing 210 is ordinarily formed of synthetic resin, etc., for the purpose of insulation.

Into the terminal insertion hole 211 are inserted a plurality of contact terminals 220, and into the front side of the housing 210 are inserted the first contact terminals 221, while into the rear side of the housing 210 are inserted the second contact terminals 222. One end of the contact terminal 220 is fixed to the printed circuit board (not shown) and the other end of the contact terminal 220 is configured to connect to and electrically contact the conductor part 1*a* of the flexible circuit cable 1. The contact terminal 220 is ordinarily formed of a copper alloy.

The actuator 230 is configured to pivot around a pivot axis 231, and to cause electrical contact between the contact terminal 220 and the conductor part 1*a* of the flexible circuit cable 1 in closed position, by pressing the flexible circuit cable 1 downward when it has been inserted into the housing 210. The molded dust cover 240 acts to prevent the introduction of dust by being installed on the housing 210 so as to be able to pivot, thus causing it to pivot together with the actuator 230. To support the pivoting of the molded dust cover 240, a rotation axis projection 241 (See FIG. 18) is formed on either end of the molded dust cover 240, and a rotation axis groove 215 is formed on either side of the housing 210 so as to enable it to be coupled with the rotation axis projection 241.

On either exterior side of the housing 10 that adjoins the rotation axis grooves 215, an inclined surface 215*a* is formed for the convenient insertion of the molded dust cover 240. The rotation axis projection 241 is inserted into the rotation axis groove 215, and the rotation axis projection 241 is configured so as to prevent upward detachment of the molded dust cover 240 due to a detachment prevention lip 215*c*, 215*d* (FIG. 22(*a*)) formed on circumference of the rotation axis groove 215. In the closed position of the actuator 230, the molded dust cover 240 prevents external exposure of the contact terminal 220 by covering it, thus effectively preventing shorts and improper actuation due to the introduction of dust or impurities.

On the front end of the molded dust cover 240 is formed a guide projection 243 (See FIG. 18) to prevent detachment from the actuator 230 and to guide the slip motion of the molded dust cover 240 when the actuator 230 is pivoted. Somewhat more specifically, the two guide projections 243 not only prevent detachment of the molded dust cover 240 and the actuator 230, but also, by virtue of being positioned at the front and back of the actuator 230, act to ensure smooth operation when the actuator 230 is pivoted, by guiding the slip motion of the molded dust cover 240 when the molded dust cover 240 is pivoted at the same rotation angle as the actuator 230.

Figure 18:
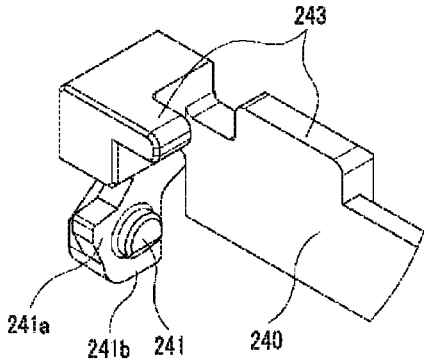
FIG. 18 is an expanded view of "A" in FIG. 11.
Figure 19:
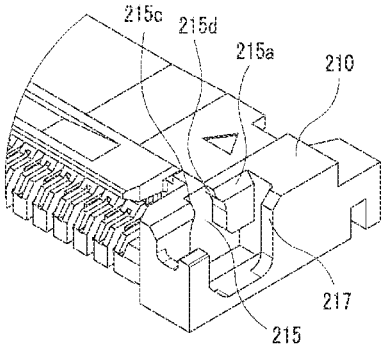
FIG. 19 is an expanded view of "B" in FIG. 11.
Figure 20A:
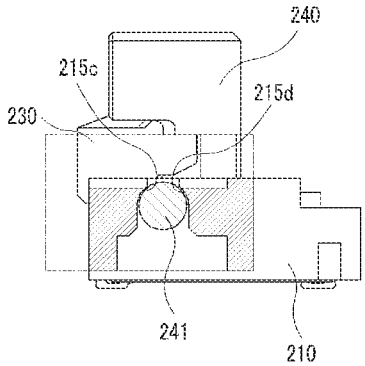
FIGS. 20*a* and 20*b* illustrate a cross-section of the hinge part of the molded dust cover in an open position.
Figure 20B:
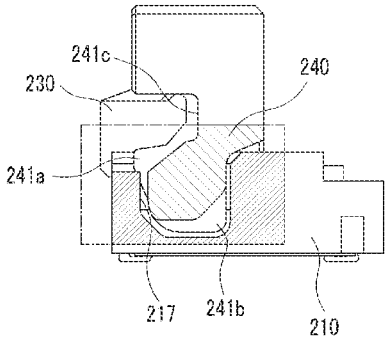
Figure 21A:
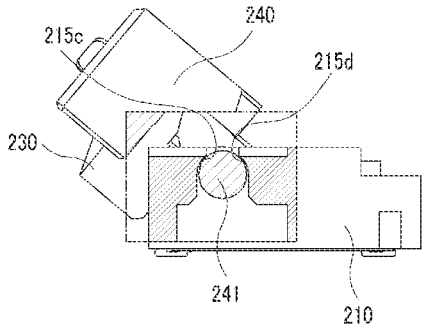
FIGS. 21*a* and 21*b* illustrate a cross-section of the hinge part of the molded dust cover, showing actuator pivoting.
Figure 21B:
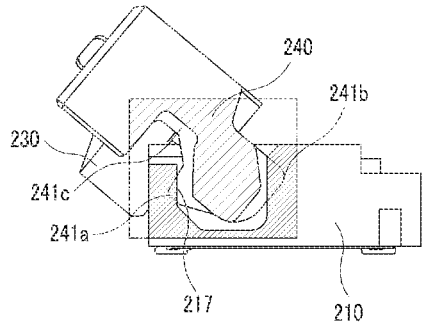
Figure 22A:
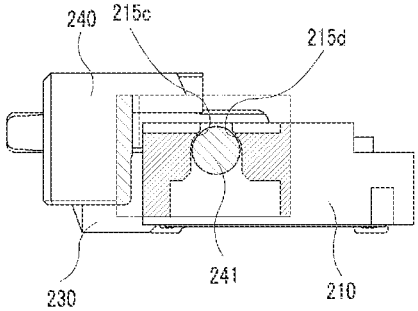
FIGS. 22*a* and 22*b* illustrate a cross-section of the hinge part of the molded dust cover in a closed position.
Figure 22B:
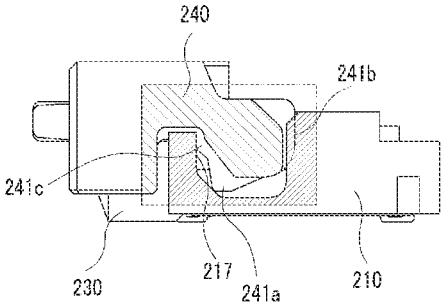

On either side of the housing 210 is formed a detachment prevention wall 217 (See FIG. 19) to prevent detachment of the molded dust cover 240; on either side of the molded dust cover 240 is formed a detachment prevention projection 241*a*, 241*b*, 241*c* (See FIGS. 18 and 22(*b*)) to correspond to the detachment prevention walls 217. In other words, when the actuator 230 is pivoted, the detachment prevention projections 241*a*, 241*b*, 241*c* always remain caught (overlapped) on the detachment prevention wall 217, so that when external force, etc., is applied to the actuator 230 or the molded dust cover 240, the molded dust cover 240 cannot detach in a downward direction (See FIGS. 20-21 and 22(*b*)).

The effected operation of the flexible circuit cable connector 100 according to the thus-configured embodiment of the Present Disclosure can be described as follows. When switching the actuator 230 from open to closed position, when the actuator 230 is pivoted, the actuator 230 pivots around the pivot axis 231. The molded dust cover 240 then pivots with the actuator 130 around the rotation axis projection 241 (See FIGS. 20-1). The guide groove 243 acts to prevent detachment (separation) of the molded dust cover 240 from the actuator 230, and to guide the slip motion of the molded dust cover 240 when the actuator 230 is pivoted. When the molded dust cover 240 rotates with the actuator 230, unintended detachment (separation) of the molded dust cover 240 from the housing 210 is prevented in closed position by overlapping of the detachment prevention projections 241*a*, 241*b*, 241*c*, formed on either side of the molded dust cover 240 to correspond with the detachment prevention walls 217, with the prevention walls 217 formed on either side of the housing 210. In the closed position of the actuator 230, the molded dust cover 240 prevents external exposure of the contact terminal 220 by covering it, thus effectively preventing shorts and improper actuation due to the introduction of dust or impurities (See FIG. 22).

As described hereinabove, the Present Disclosure has the effects that due to coupling of the molded dust cover with the actuator as a single unit, it operates together with the actuator, and due to being made of synthetic resin, the assembly process is simplified and noise is not produced in the circuit. In addition, the Present Disclosure can increase product reliability by preventing improper actuation or damage to the circuit due to a short, by effectively preventing the introduction of dust and contaminants into the actuator due to the molded dust cover being configured to slip (or slide) with respect to the actuator when the actuator is changed from open to closed position. In addition, the Present Disclosure has the effect of enabling smooth actuation of the circuit by guiding the slip motion of the molded dust cover during axis rotation, in addition to preventing detachment of the molded dust cover from the actuator by the use of two guide projections. In addition, the Present Disclosure can increase the reliability of the product by preventing downward separation of the molded dust cover when external force, etc. is applied to the actuator or the molded dust cover, due to the separation prevention wall.

While a preferred embodiment of the Present Disclosure is shown and described, it is envisioned that those skilled in the art may devise various modifications without departing from the spirit and scope of the foregoing Description and the appended Claims.

What is claimed is:

1. A connector for a flexible circuit cable, comprising:

a housing on the front whereof is formed an insertion slot for a flexible circuit cable, and on the front and rear whereof is formed a terminal insertion hole;

a plurality of contact terminals inserted into the front and rear of the housing via the terminal insertion holes;

an actuator that pivots around a pivot axis and, when in closed position, creates electrical contact between the contact terminal and the conductor part of the flexible circuit cable by pressing the inserted flexible circuit cable down and into the housing; and a molded dust cover that rotates with the actuator and is installed on the housing to enable rotation and thus prevent the introduction of dust;

wherein on either end part of the molded dust cover is formed a rotation axis groove, and rotation axis projections are formed on either side of the housing to enable coupling with the rotation axis grooves.

2. The connector of claim 1, wherein on the front end of the molded dust cover is formed a guide projection, to prevent detachment from the actuator and to guide the slip motion of the molded dust cover when the actuator is rotated.

3. The connector of claim 2, wherein in the closed position of the actuator, the either end part has a "U" shape so that the molded dust cover cannot detach in either a vertical or horizontal direction.

4. The connector of claim 1, wherein in the closed position of the actuator, the either end part has a "U" shape so that the molded dust cover cannot detach in either a vertical or horizontal direction.

5. The connector of claim 1, wherein on either side of the housing is formed a detachment prevention wall to prevent detachment of the molded dust cover.

6. A connector for a flexible circuit cable, comprising:

a housing on the front whereof is formed an insertion slot for a flexible circuit cable, and on the front and rear whereof a terminal insertion hole is formed;

a plurality of contact terminals inserted into the front and rear of the housing via the terminal insertion holes;

an actuator that pivots around a pivot axis and, when in closed position, creates electrical contact between the contact terminal and the conductor part of the flexible circuit cable by pressing the inserted flexible circuit cable down and into the housing; and a molded dust cover that pivots with the actuator and is installed on the housing so as to enable rotation and thus prevent the introduction of dust; and having a structure wherein on either end of the molded dust cover is formed a rotation axis projection, and rotation axis grooves are formed on either side of the housing so as to enable coupling with the rotation axis grooves.

7. The connector of claim 6, wherein the rotation axis projection is inserted into the rotation axis groove, and the rotation axis projection is configured to prevent upward detachment of the molded dust cover due to a detachment prevention lip formed on circumference of the rotation axis groove.

8. The connector of claim 6, wherein on the front end of the molded dust cover is formed a guide projection to prevent detachment from the actuator and to guide the slip motion of the molded dust cover when the actuator is pivoted

9. The connector of claim 6, wherein on either side of the housing is formed a detachment prevention wall to prevent detachment of the molded dust cover.

10. The connector of claim 9, wherein on either side of the molded dust cover is formed a detachment prevention projection to correspond to the detachment prevention walls.

11. The connector of claim 6, wherein an inclined surface is formed on either exterior side of the housing that adjoins the rotation axis groove, so as to facilitate insertion of the molded dust cover.

12. The connector of claim 11, wherein on the front end of the molded dust cover is formed a guide projection to prevent detachment from the actuator and to guide the slip motion of the molded dust cover when the actuator is pivoted.

13. The connector of claim 11, wherein on either side of the housing is formed a detachment prevention wall to prevent detachment of the molded dust cover.

14. The connector of claim 13, wherein on either side of the molded dust cover is formed a detachment prevention projection to correspond to the detachment prevention walls.

* * * * *